United States Patent [19]

Desourdy

[11] Patent Number: 4,484,853

[45] Date of Patent: Nov. 27, 1984

[54] SHELTER CARRIAGE SYSTEM

[76] Inventor: Bernard Desourdy, 545 de Normandie St., Longueuil, Canada, J4H 3P6

[21] Appl. No.: 330,081

[22] Filed: Dec. 14, 1981

[51] Int. Cl.[3] ..... B60P 1/52; E04B 1/72

[52] U.S. Cl. ..... 414/534; 414/12; 52/143

[58] Field of Search ..... 52/79.1, 79.5, 64, 143, 52/122; 296/156–175; 414/534, 12

[56] References Cited

U.S. PATENT DOCUMENTS

| | | | |
|---|---|---|---|
| 2,368,936 | 2/1945 | McGehee | 52/69 |
| 2,904,850 | 9/1959 | Couse et al. . | |
| 3,247,630 | 4/1966 | Kesting | 52/143 |
| 3,492,767 | 2/1970 | Pincus . | |
| 3,879,050 | 4/1975 | Young | 52/143 |
| 4,311,322 | 1/1982 | Verros | 296/174 |

FOREIGN PATENT DOCUMENTS

| | | | |
|---|---|---|---|
| 556168 | 4/1958 | Canada . | |
| 694632 | 9/1964 | Canada . | |
| 732798 | 4/1966 | Canada . | |
| 1001587 | 12/1976 | Canada . | |
| 1027727 | 3/1978 | Canada . | |
| 91122 | 1/1958 | Norway | 52/143 |
| 679415 | 9/1952 | United Kingdom | 52/143 |

*Primary Examiner*—Alfred C. Perham

[57] ABSTRACT

A system for carriage of a shelter such as a garage in erected form with a trailer or truck adapted to readily mount and carry such shelter on it such that the truck or trailer may be conveniently used to carry loads on a work site; the shelter forms a garage for the trailer or truck, and the latter is also used to readily move the shelter or garage to another site whenever desired. The trailer includes laterally extending arms to engage under the lateral sills of the shelter and the latter has a front wall with portions folding away for the passage of the arms upon loading and unloading of the shelter on the trailer or truck.

8 Claims, 6 Drawing Figures

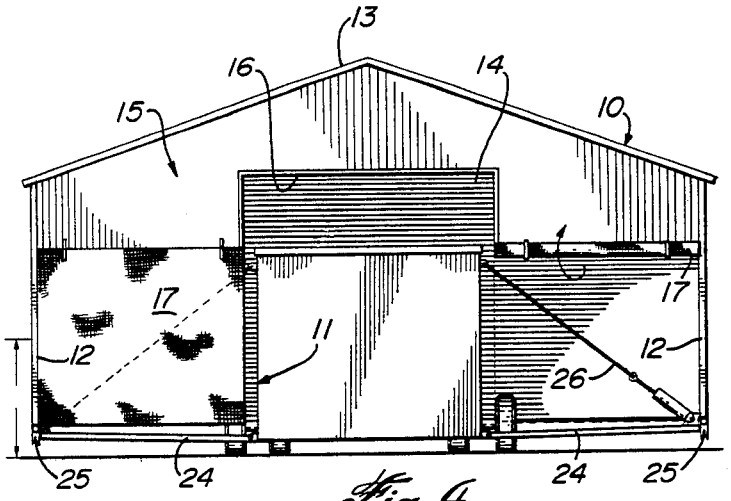
Fig. 4
Fig. 5
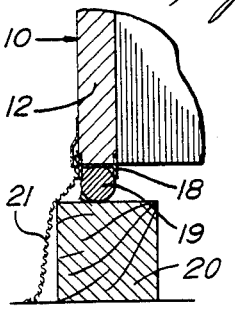
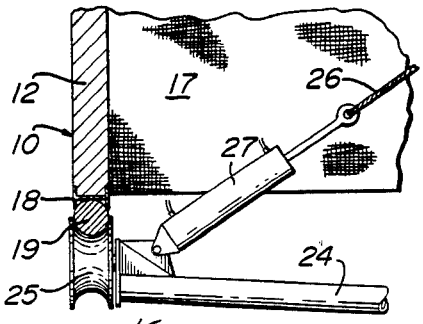
Fig. 6

SHELTER CARRIAGE SYSTEM

FIELD OF THE INVENTION

This invention relates to a system for the carriage of an erected shelter such as a garage or the like building and in particular to a shelter carriage system of the type including a vehicle particularly adapted to form a carrier for such building and including also a shelter adapted to be so carried.

DESCRIPTION OF THE PRIOR ART

To our knowledge, there have not been proposed heretofore a shelter carriage system of the above type. The trailers or trucks that have been proposed before were not adapted to carry a shelter in erected form on them and the shelters or buildings were not specifically made to be carried in erected form.

SUMMARY OF THE INVENTION

It is a general object of the present invention to provide a shelter carriage system of the above type; that is, wherein a truck or trailer and the shelter are cooperatively constructed and arranged to readily carry a shelter in erected form.

It is an object of the present invention to provide a trailer or truck particularly adapted to carry an erected shelter without dismantling it.

It is a further object of the present invention to provide a shelter carriage system of the above type wherein the truck or trailer may be used to carry parts, tools, and/or materials on a work site and the shelter is made to form a garage for the trailer or truck to readily protect its load against bad weather and wherein the trailer or truck may engage under the shelter and carry it to another work site.

BRIEF DESCRIPTION OF THE DRAWINGS

The above and other objects and advantages of the present invention will be better understood with reference to the following detailed description of a preferred embodiment thereof which is illustrated, by way of example, in the accompanying drawings; in which:

FIG. 4 is a front view of the shelter carriage system, as seen from the right in FIG. 1;

FIG. 5 is a transverse cross section through one lateral sill of the garage with the same installed on blocks on the work site; and FIG. 6 is a similar transverse cross section as in FIG. 5 but showing the lateral sill in carried position on rollers and a lateral arm of the trailer.

DESCRIPTION OF THE PREFERRED EMBODIMENT

Figure 1:
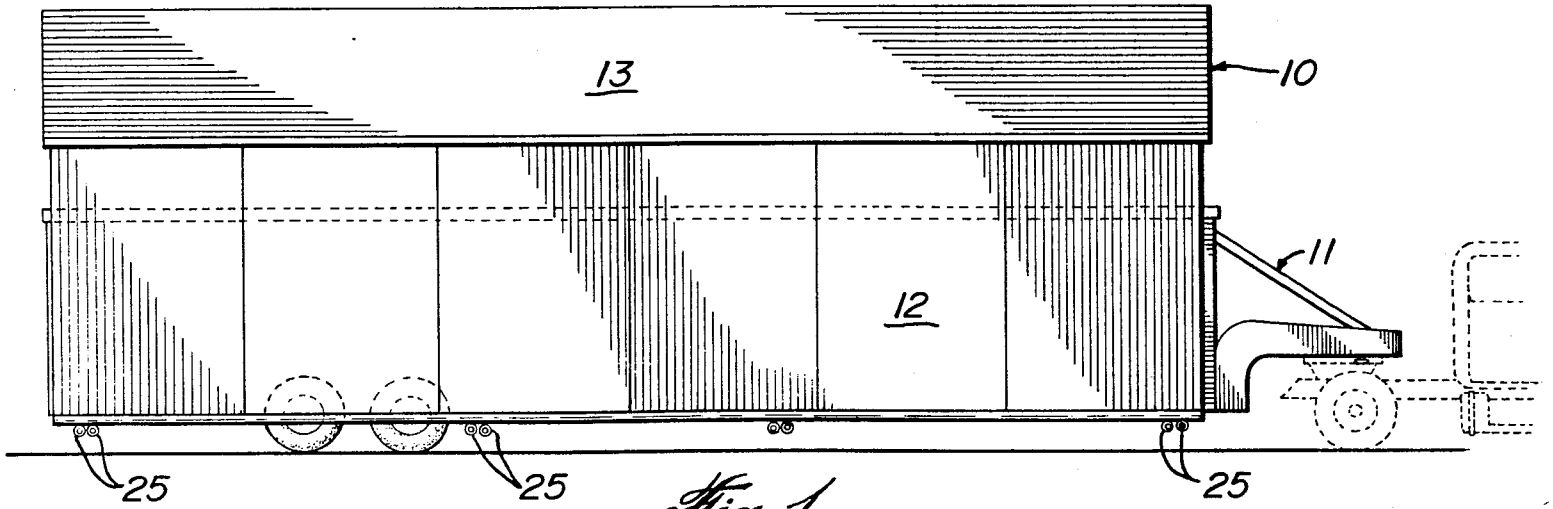
FIG. 1 is a side elevation view of a shelter carriage system according to the present invention and including a trailer and a garage operatively mounted on it.
Figure 2:
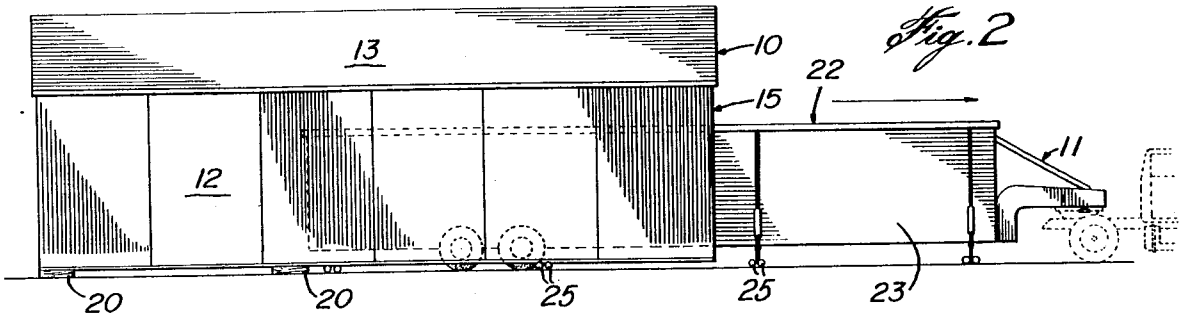
FIG. 2 is a side elevation view showing the mode of unloading the garage upon removal of the trailer from under it.
Figure 3:
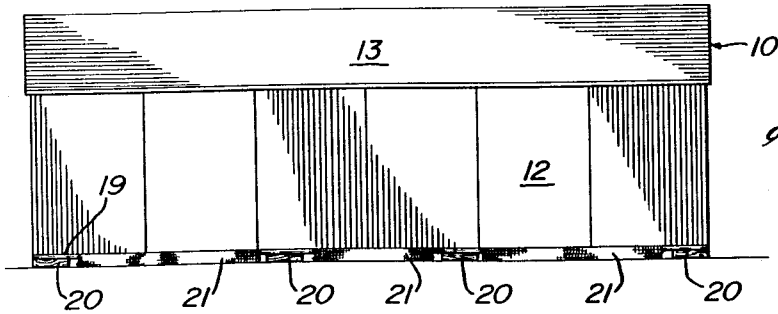
FIG. 3 is a side elevation view of the garage in fully installed position on a work site.

The illustrated shelter or garage carriage system comprises a garage 10 and a trailer 11 adapted to carry it.

The garage 10 includes opposite side walls 12, a roof 13, a rear wall 14, and a front wall at 15. The latter is formed with an entrance aperture 16 of appropriate size for entrance of the trailer 11 in the garage 10. The front wall 15 also includes a curtain 17 of any foldable material such as canvas on each side of the entrance aperture 16. When the curtains 17 are rolled up as on the right in FIG. 4, the entrance aperture is thus widened laterally the full width of the garage 10.

An H shape metal extrusion member 18 is fixed with its web flat against the bottom edge of each side wall 12 to form a downwardly opening longitudinal groove in which is retained a lateral sill 19 of circular cross section. The garage 10 is operatively installed on blocks 20 spaced under the lateral sill 19. Curtain or skirts 21 are fixedly attached along the lower edge of each side wall 12 and operatively deployed to form a windscreen transversely under the lateral sills 19.

The trailer 11 comprises a vehicle body including mainly a rectangular box 22 having a pair of side walls 23. Lateral arms 24 are pivoted at one end to the lower edge portion of each side wall 23 and are spaced apart one from another along those side walls. The arms 24 are thus pivoted about a longitudinal axis. The outer end of each lateral arm 24 rotatably carries a pair of rollers 25 that rollingly engage under the corresponding lateral sill 19. Each roller 25 is peripherally grooved with a transversely-rounded profile complementary to the transverse profile of the lateral sill 19. A cable 26 is attached at a lower end each to a corresponding arm 24 at an upper end at the top of the corresponding side wall 23. A cable length adjusting device 27 is preferably serially attached to each cable 26. Each device 27 is preferably a hydraulic cylinder and piston unit with an independent hydraulic control circuit operated by the driver of the trailer truck.

The box 22 of the trailer 11 is used to carry any desired load on a work site and to the work site. Such load can, for instance, be parts, tools or materials required for a project. The garage 10 is used as a simple garage after its installation on a site. Then, the lateral sills 19 rest on blocks 20. The garage is carried away by successively engaging the rollers 25 under the lateral sills 19, while successively removing the blocks 20.

When the garage has reached a new site for its installation, the trailer is slowly driven out of the garage while blocks 20 are simultaneously placed under the lateral sills to support the garage when its load is shifted on them rather than on the arms 24 and rollers 25.

Selective operation of the hydraulic cylinder and piston units 27 permits to raise and lower portions of the garage within certain limits during transfer of the garage between rollers 25 and blocks 20 and to raise or lower the entire garage or portion thereof during its transport over rough ground in order to clear obstacles.

When only the trailer 11 is hauled by the trailer truck over a regular road, the arms 24 are attached in elevated vertical position along side walls 23.

What I claim is:

1. A shelter carriage system comprising a vehicle body defining a pair of opposite lateral sides, arms having each an inner end pivoted to the lower section of the vehicle body on the opposite lateral sides thereof to allow operative outward deployment of said arms relative to the lateral sides and having each an outer end forming a seat constructed and arranged to upwardly engage against a lateral sill of an overlying shelter to support the latter, and a brace collapsably connecting the outer end of each of said arms to the corresponding lateral side at the upper section of said vehicle body and means to operatively adjust the effective length of each of said braces independently of each other.

2. A shelter carriage system as defined in claim 1, wherein the vehicle body includes a box having opposite lateral sides, said arms are connected to the lateral sides of said box outwardly thereof and are pivotable transversely relative thereto.

3. A shelter carriage system as defined in claim 2, wherein at least one roller is carried on the outer end of each of said arms and forms a seat rollably carrying the corresponding lateral sill of a shelter resting thereon.

4. A shelter carriage system as defined in claim 3, wherein said arms are laterally spaced apart one from another longitudinally of the vehicle body and have an inner end pivoted at the bottom of the corresponding lateral side of the box, and a pair of rollers are rotatably connected to the outer end of each of said arms in rolling alignment one with the other longitudinally of the vehicle body.

5. A shelter carriage system as defined in claim 4, wherein each of said braces includes a cable having an upper end attached to the top of the corresponding lateral side and a lower end attached to the outer end of the corresponding arm.

6. A shelter carriage system as defined in claim 5, wherein said rollers have each a peripheral groove to complementarily engage the bottom of said lateral sills.

7. A shelter carriage system as defined in claim 1, 3 or 5, further including power-operated means varying the effective length of each of said braces to raise or lower the shelter supported by said arms relative to said vehicle body.

8. A shelter carriage system as defined in claim 5, or 6, further including a hydraulic cylinder and piston unit for each cable and serially connected therewith, for selectively varying the effective length of each cable to raise or lower the entire shelter or portions thereof by said arms relative to said vehicle body.

* * * * *